United States Patent [19]

Morgner et al.

[11] 4,035,030

[45] July 12, 1977

[54] DEVICE FOR PNEUMATICALLY CONVEYING FIBERS OR FIBER-CONTAINING MATERIALS

[75] Inventors: Friedrich Wilhelm Morgner, Grunenbaumchen; Franz Höck, Heiligenhaus, both of Germany

[73] Assignee: Temafa, Textilmaschinenfabrik Meissner, Morgner & Co. GmbH, An der Zinkhutte, Germany

[21] Appl. No.: 593,550

[22] Filed: July 7, 1975

[30] Foreign Application Priority Data

July 5, 1974 Germany ..... 2432239

[51] Int. Cl.[2] ..... B65G 53/40

[52] U.S. Cl. ..... 302/37

[58] Field of Search ..... 302/8, 37, 38; 198/128, 198/6

[56] References Cited

U.S. PATENT DOCUMENTS

| | | | |
|---|---|---|---|
| 813,022 | 2/1906 | Queneau | 198/128 |
| 1,203,841 | 11/1916 | Bancel | 302/37 |
| 1,658,734 | 2/1928 | Nelson | 198/128 |
| 1,671,840 | 5/1928 | Puglisi | 302/37 |
| 1,739,604 | 12/1929 | Monroe | 302/37 |
| 1,789,874 | 1/1931 | Lilly | 198/128 |
| 1,806,110 | 5/1931 | Menke et al. | 198/128 |
| 1,814,171 | 7/1931 | Marsh | 198/128 |
| 1,889,816 | 12/1932 | White | 302/37 |
| 2,588,198 | 3/1952 | Bevington | 302/42 |
| 2,766,872 | 10/1956 | Pillsbury | 198/128 |
| 3,490,685 | 1/1970 | Ferri | 302/37 |

FOREIGN PATENT DOCUMENTS

| | | | |
|---|---|---|---|
| 340,702 | 9/1921 | Germany | 302/37 |

*Primary Examiner*—Evon C. Blunk
*Assistant Examiner*—Jeffrey V. Nase
*Attorney, Agent, or Firm*—Robert D. Yeager; Howard G. Massung

[57] ABSTRACT

A centrifugal blower for conveying an air and particle mixture having an impeller with a curved revolving plate portion, that is raised in the center, with backward curving blades connected thereto between the raised center portion and the outer periphery. The curved blades extend in a perpendicular direction with respect to the plane defined by the outer periphery of the plate portion. The curved blades have a free top edge and are connected to the plate portion starting at the end of the raised center portion. An inclined edge on the blade extends from the connection point at the raised center portion to the free top edge. The angle of the inclined blade edge from the point of connection at the raised center portion to the free top edge is greater than 40° relative to the longitudinal axis of the impeller. The slope between the raised center portion and the outer periphery of the base plate portion is curved in a manner to facilitate particle movement.

11 Claims, 2 Drawing Figures

DEVICE FOR PNEUMATICALLY CONVEYING FIBERS OR FIBER-CONTAINING MATERIALS

BACKGROUND OF THE INVENTION

1. Field of the Invention

This invention relates to a device for conveying a mixture of air and fibers or other particles and more particularly to an improved centrifugal blower provided with a multi-dimensionally curved impeller and multi-dimensionally curved blades in an open construction.

2. Description of the Prior Art

Centrifugal blowers for conveying fiber and air mixtures have a housing with an intake disposed along the longitudinal axis of the impeller. The fiber and air mixture is drawn into the blower along the impeller's longitudinal axis and is then moved radially outward past the periphery of the impeller. The fiber-air mixture as it is moved radially outward is accelerated in a circumferential or aximuthal direction. The outlet for the blower is normally located on the housing outward from the periphery of the impeller.

Various designs of centrifugal blowers for the purpose of conveying fibrous materials and air mixtures are known in the prior art. Impeller constructions with straight blades or curved blades installed on flat impeller plates have been proposed. For example, in "Ventilatoranlagen" by Mode, 4th edition, page 82, an open impeller with a flat disk wheel has been proposed for pneumatic conveying of solids, and in "Ventilatoren" by Eck, 8th edition, page 479, an impeller with a flat disk wheel is also proposed. Blowers equipped with impellers of this construction exhibit considerable drawbacks in fiber conveying due to the large amount of noise generated as the result of the turbulence. The service life of the blades in these type of constructions is short due to the high impact load exerted on the blades by the fibers or particles. Blowers utilizing the above construction provide for a low draw-in or suction on the fiber intake. They exhibit a high consumption of energy as a result of their reduced efficiency and the unfavorable conveying of the fibers.

The inventors of the instant application recognized that these disadvantages with the prior art blowers are due to the unfavorable guidance of the flow of the fiber and air mixture. The problem is particularly acute when greater bulk weights or denser particles are used. The fibers or particles posses a low relative velocity with respect to the intake air and consequently do not follow the flow path of the air directly. The particles do not accelerate to the speed of the flowing air and more particularly to its peripheral speed component until they strike the impeller blades. Consequently, straight blades receive high impact stress from the fibers or particles and this frequently causes the blades to bend over. When the blades are curved and the plate is straight, the deflection of the fibers from the axial blower intake to the radial periphery of the impeller does not occur without a relatively large motion with respect to the intake air. The air material flow is unfavorably guided by the impeller and there is a high material load at the point of impact of the fiber on the impeller plate. This can damage both the fiber, by causing it to splinter or shorten, and the impeller plate. Moreover, when a dirty wool fiber is used, a high degree of erosion is caused at these points by the entrapped solids or sand particles in the fibers.

In order to relieve these drawbacks, it has been proposed in the past to design the blades with a low height. However, this has the disadvantage of limiting the output of the blower with a given impeller diameter and therefore opposes the construction desired in a pneumatic heavy duty installation for conveying large amounts of fibers.

SUMMARY OF THE INVENTION

It has been found by constructing the impeller blade according to the flow path of the binary fiber air mixture, while deflecting the axial inflow into the radial impeller flow, and by constructing the blades in a backwardly curved shape, relative to the acceleration of the binary air and fiber mixture in the radial and peripheral directions, a three-dimensional impeller is produced which to a large extent eliminates the drawbacks of other prior art impellers for pneumatic conveying of fibers.

A blade according to the teachings of the present invention is constructed by using both the plate and the blades as thrust deflector members and by joining these members by means of a welded seam. The impeller plate or base is raised in the center and slopes to the outside. Backwardly curved blades are connected thereto with a free top edge. The blades extend from the center raised portion to the outer periphery of the impeller plate along a backwardly curved path. An inclined edge extends from the outer free top edge of the blades to the connection at the raised inner center portion of the impeller plate. The angle of this inclined portion of the impeller blade is very important, since step impeller blades in proximity to the raised center of the impeller plate hinder the flow of fibers and lead to clogging. The critical value of the slope of the inclined or slanted blades is 40° relative to the axial perpendicular. If possible, the angle of the sloped portion of the impeller blades should be even greater than 40°. Attachment of the curved blades to the impeller base is made so that the innermost portion of the blade is connected to the beginning of the downward sloping portion of the impeller plate. That is, the radially inner connection of the curved blades is to the portion of the center plate where the downward curvature of the inner raised portion starts.

A hub is connected to the raised center portion of the impeller plate. The slope of the curved portion connecting the raised center portion and the outer periphery is selected to facilitate moving the air-fiber mixture from an axial direction to a radial direction. The slope selected minimizes the impeller wear, prevents clogging and provides for a high efficiency blower.

It is an object of this invention to teach a centrifugal blower, particularly suitable for conveying fibrous particles, having an impeller base formed with a raised center portion, which has a curved slope towards the outer periphery, and a plurality of backwardly curved blades connected to the impeller base, with each blade having a slanted edge portion extending from the edge of the raised impeller center to a top free edge.

BRIEF DESCRIPTION OF THE DRAWINGS

For a better understanding of the invention, reference may be had to the preferred embodiments exemplary of the invention shown in the accompanying drawings in which.

DESCRIPTION OF THE PREFERRED EMBODIMENT

Figure 1:
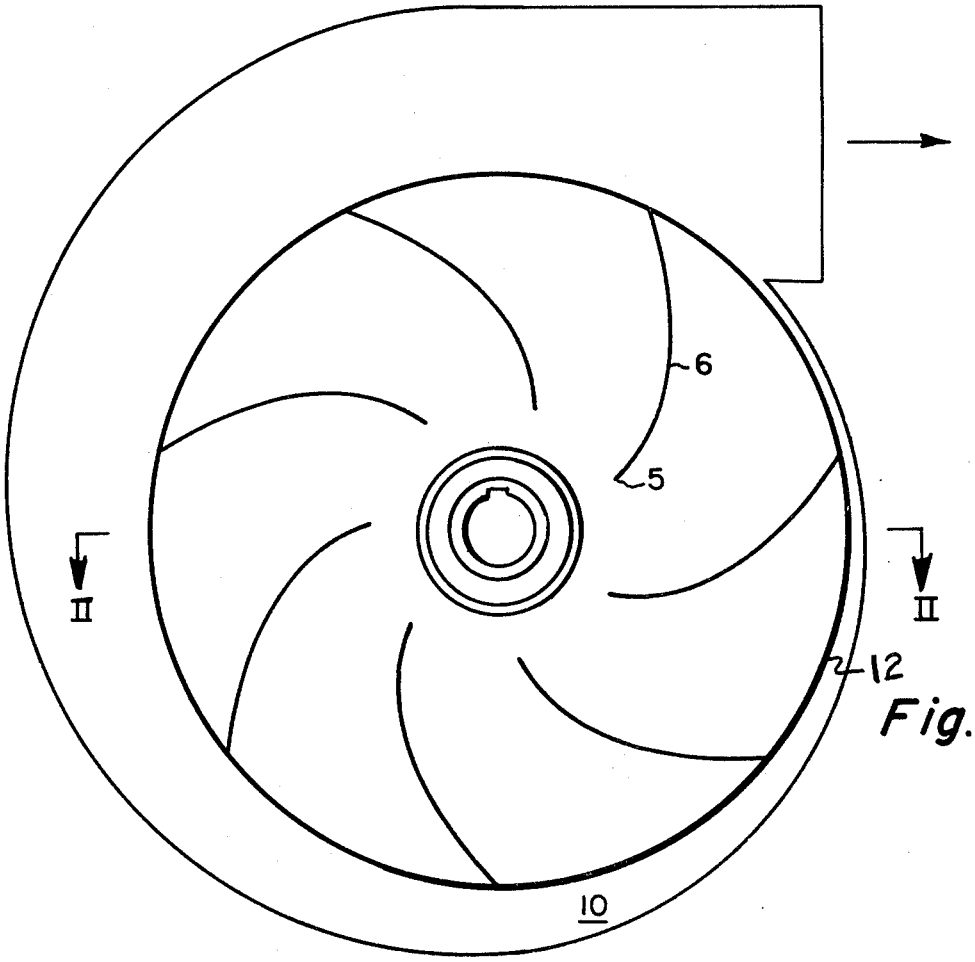
FIG. 1 is a plan view of an impeller for a centrifugal blower utilizing the teaching of the present invention.

Referring now to the drawings, and FIG. 1 in particular, there is shown a plan view of an impeller configuration utilizing the teaching of the present invention. Impeller 10 comprises a base portion 12 having curved blades 6 attached thereto. The raised inner portion of the plate or base portion 12 is connected to hub 1 by suitable means such as welding. The impeller as viewed in FIG. 1 rotates in a clockwise direction. A sloping curved portion extends from the outer edge 2 of the inner raised portion to the outer periphery 4 of base portion 12. This curved sloping portion containing point 3 and extending between points 2 and 4 serves chiefly for deflecting the axial inward flow of the air-fiber mixture into a radial flow direction. The outer periphery 4 of the base plate 12 runs at a short distance from the blower housing. The beginning 5 of blade 6 is preferably located at the start of the downward slope of the inner raised portion of base 12. That is, the inner portion 5 of the blade 6 is preferably connected to the outer circumferential edge 2 of the raised portion of impeller base 12. Each blade 6 has a free outer end 8 and a slanting portion 7 indicated schematically in FIG. 2. The angle 28 of the slanting portion 7 is greater than 40° relative to the longitudinal axis of the impeller. The critical value of the slope of the slanting portion 7 is 40°. If possible the angle 28 of the sloped portion 7 should be even greater than 40°. The outer free edge 8 of the blade 6 is preferably straight. This outer free edge runs parallel to the side of the blower housing.

The flow of the fiber and air mixture which enters the blower housing along the longitudinal axis of hub 1 is accelerated in the radial and the circumferential or azimuthal direction. In so doing the axial flow component of the air-fiber mixture is gently decreased to zero. The radial acceleration of the air which starts after entrance into the housing but before reaching the hub also deflects fibers to such an extent that the fibers hardly strike hub 1 or the raised center portion of impeller 12 but chiefly strike gently the backwardly curved portion of the impeller plate between points 2 and 4. The particles which do strike the curved portion of the impeller plate tend to strike it tangentially with a low velocity. Similarly, acceleration of the fibers in the circumferential direction does not cause the fibers to strike the blade 6 with great impact, but rather causes the particles to slide off on top side of the blades 6.

Figure 2:
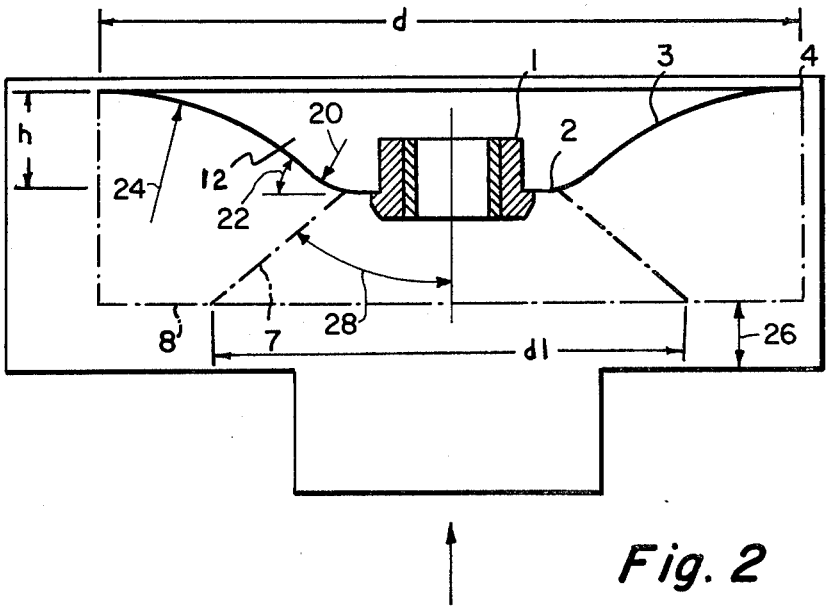
FIG. 2 shows a partial section view through the impeller shown in FIG. 1 along the line II—II with selected portions of the impeller blades shown in phantom lines, for clarity, the path they would define as the impeller rotates.

Structurally the impeller plate 12 is constructed so that the inner radius of curvature 20 between the points indicated as 2 and 3, in FIG. 2, ranges from 1/5 to 1/2 of the diameter, *d*, of impeller plate 12. The height h of the impeller plate between the inner raised portion and the outer periphery ranges from 1/5 to 1/10 of the impeller diameter *d*. The slope 22 of the curved portion between points 2 and 4 ranges from 30° to 50° relative to the horizontal straight line portion of base 12. The radius of curvature 24 from point 3 to point 4 ranges from 0.2 to 0.6 times the diameter of the impeller.

Impeller blades 6 are constructed so they rest on the plate 12 in a backwardly curved form and are shaped after the flow curvature expected from a medium density fiber ball in air. The free outer edge of the blade may be either straight or beveled at its upper free end 8, with the straight design seeming to be more advantageous.

The blower housing around the impeller may be designed in the usual manner well known in the prior art as described for example in "Ventilatoranlagen" by Mode, 4th edition, page 72. An essential feature for the efficiency of the impeller of the invention is a lateral gap 26 between the top edge of the blades 6 and the blower housing. The dimensions of the preferred gap 26 being between 0.5 to 0.2 times the diameter, *d*, of the impeller 10. The preferred blade 6 height ranges from 0.1 to 0.5 times the diameter, *d*, of the impeller 10.

In comparision with other blower designs, the blower disclosed in the instant application has a steep flow curve characteristic. Thus when there is a change in the fiber load, a marked change in the pressure generated by the blower is noted. This characteristic is particularly advantageous when there is incipient clogging since the blower of the present invention blows the pipeline clear as a result of the sharp increase in pressure. A blower utilizing the disclosed impeller also has an increased intake suction. The considerably greater fiber intake capacity of the disclosed blower can be accommodated and conveyed easily by the associated pipeline since any fiber buildup causes a pressure increase which relieves the clogging. This construction provides that on the whole a lesser amount of air is necessary for transporting a given amount of fiber, and consequently less waste air laden with dust particles is generated in the course of conveying. The reduction of dust particles in the air contributes to improved working conditions. Moreover, the lesser amount of carrier air makes it possible to use smaller pipe diameters for transporting the same quantity of fibers and this results in considerable savings in the materials and in the space occupied by the conveying system. The optimum flow guidance of the fiber and air mixture in the impeller leads to a substantial reduction in noise as the result of the lesser relative velocities and formation of eddies. Also, the same effect results in a substantially reduced power consumption by the blower. In other words, increased efficiency in the transportation of the fiber and air mixture through the blower and the resulting conveying system results. These improvements have also resulted in substantial changes as far as the treatment of fibers is concerned. Fiber damage due to impeller impact has been greatly reduced.

The geometry of a typical blower impeller according to the teaching of the present invention, will now be described in detail. For example, an impeller with a diameter, *d*, of 700 millimeters has 7 blades with a stretched-out length of 300 millimeters each and a maximum height of 200 millimeters. 125 millimeters of the free blade length is formed with a straight free upper edge 8. The free inside diameter of hub 12 up to the point 2 of blade attachment is 240 millimeters. The blades reach their maximum height at an inner diameter, *d*1, of 525 millimeters. The height, *h*, of the raised center of plate 12 is approximately 108 millimeters. The radius of curvature 20 intermediate points 2 and 3 is 65 millimeters and the radius of curvature 24 intermediate points 3 and 4 is 265 millimeters. On the suction side of the blower and on the output delivery side of the blower housing pipe connections with a diameter of 300 millimeters are provided. The open width of the housing is 300 millimeters, a lateral gap being formed with a dimension of 20 millimeters on the plate side and with a dimension of 70 millimeters on the blade side. The sheet gauge of the impeller is 5 millimeters. The conveying output of the blower is 3 tons of fiber per hour.

The centrifugal blower of the invention exhibits the most favorable properties in conveying fibers and materials containing fibers. However, it may also be used for other applications of conveying solids pneumatically. It is particularly useful when the solids have a low density and the blower is therefore particularly adaptable, due to its extraordinary intake capacity, for these relatively light materials. It would be advantageous for use for conveying of lightweight powder, styrofoam, feathers and the like.

What is claimed is:

1. Apparatus for pneumatically conveying materials comprising:

an impeller supported for rotation about its longitudinal axis;

said impeller comprises a circular curved base portion that is raised in the center and slopes to the outer periphery wherein the transition from the raised center portion of the base to the outer periphery has a first portion (20) with an inward radius of curvature of 0.05 to 0.2 times the diameter of said impeller and a second portion (24) having an outward radius of curvature which is equal to 0.2 to 0.6 times the diameter of said impeller;

said impeller further compirses a plurality of backwardly curved blades connected to said circular curved base portion having a free outer edge and a slanted edge extending from the free outer edge to the raised center of said circular curved base portion; and including, a housing surrounding said impeller having an inlet opening along the longidutindal axis of said impeller for receiving material to be conveyed.

2. Apparatus as claimed in claim 1 wherein the angle (28) of the slanted edge is 40° or greater relative to the longitudinal axis of said impeller.

3. Apparatus as claimed in claim 2 wherein the raised height (*h*) of said base is in the range of 1/5 to 1/10 of the diameter of the impeller.

4. Apparatus as claimed in claim 2 wherein the angle (28) of the slanted edge is between 40° and 70° relative to the longitudinal axis of said impeller.

5. Apparatus as claimed in claim 1 wherein the raised center portion of the base is in the range of 1/5 to 1/10 of the diameter of the impeller.

6. Apparatus as claimed in claim 1 wherein the maximum blade height formed at the outer periphery of the impeller is equal to 0.1 to 0.5 times the diameter of the impeller.

7. Apparatus as claimed in claim 1 wherein:

said housing within which the impeller is disposed has the free outer edge of said plurality of backwardly curved blades positioned parallel to the sidewall of said housing.

8. Apparatus as claimed in claim 7 wherein a lateral gap (26) exists between the free upper edge of said blades and the housing and is equal to 0.05 to 0.2 times the diameter of the impeller.

9. A blower for pneumatically conveying fiber-containing materials comprising:

a housing;

an impeller supported for rotational movement about its longitudinal axis, within said housing, having a circular curved base portion, which is raised in the center and extends into a first curved position, having an inner radius of curvature of 0.05 to 0.2 of the impeller diameter, and slopes to the outer periphery along a second curved portion, having an outer radius of curvature of 0.2 to 0.6 of the impeller diameter;

a plurality of backwardly curved blades extending from said impeller having a free outer edge extending from the periphery of said impeller, a slanted edge extending from the raised center of said impeller, and a free top edge extending between said free outer edge and said slanted edge;

said slanted edge slanting at an angle of at least 40° from the longitudinal axis of said impeller; and said housing and said impeller disposed to define a lateral gap between the top edge of the blade and said blower housing which is 0.5 to 0.2 times the diameter of the impeller.

10. A blower as claimed in claim 9 wherein:

the maximum height of the blade at the outer periphery of said impeller is equal to 0.1 to 0.5 times the diameter of said impeller.

11. A blower as claimed in claim 9 wherein: the height of said impeller between the inner raised portion and the outer periphery ranges from 0.1 to 0.2 of the impeller diameter.

* * * * *

UNITED STATES PATENT AND TRADEMARK OFFICE

CERTIFICATE OF CORRECTION

PATENT NO. : 4,035,030

DATED : July 12, 1977

INVENTOR(S) : Friedrich Wilhelm Morgner and Franz Hock

It is certified that error appears in the above-identified patent and that said Letters Patent are hereby corrected as shown below:

Column 3, line 60, "1/2" should read --1/20--, line 65, "4" should read --3--;

Column 6, line 42, "0.5" should read --.05--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*